US010021748B2

(12) United States Patent
Tan

(10) Patent No.: US 10,021,748 B2
(45) Date of Patent: Jul. 10, 2018

(54) NOTIFICATION APPLIANCE

(71) Applicant: Siemens Schweiz AG, Zurich (CH)

(72) Inventor: Jian Tan, Beijing (CN)

(73) Assignee: SIEMENS SCHWEIZ AG, Zurich (CH)

( * ) Notice: Subject to any disclaimer, the term of this patent is extended or adjusted under 35 U.S.C. 154(b) by 0 days.

(21) Appl. No.: 15/247,258

(22) Filed: Aug. 25, 2016

(65) Prior Publication Data

US 2017/0064786 A1 Mar. 2, 2017

(30) Foreign Application Priority Data

Aug. 25, 2015 (CN) ..... 2015 1 0528343

(51) Int. Cl.

| | |
|---|---|
| ***G08B 3/00*** | (2006.01) |
| ***H05B 33/08*** | (2006.01) |
| ***G08B 5/38*** | (2006.01) |
| ***G08B 17/00*** | (2006.01) |

(52) U.S. Cl.

CPC ..... *H05B 33/0845* (2013.01); *G08B 5/38* (2013.01); *G08B 17/00* (2013.01); *H05B 33/0824* (2013.01); *H05B 33/0842* (2013.01)

(58) Field of Classification Search

CPC ..... H05B 33/0845; H05B 33/0824; H05B 33/0842; G08B 5/38; G08B 17/00

USPC ..... 340/691.8

See application file for complete search history.

(56) References Cited

U.S. PATENT DOCUMENTS

| | | | | |
|---|---|---|---|---|
| 8,339,068 | B2 | 12/2012 | Simmers | 315/297 |
| 8,629,619 | B2 | 1/2014 | Clauberg et al. | 318/125 |
| 8,742,684 | B2 | 6/2014 | Melanson | 315/291 |
| 8,760,301 | B2 * | 6/2014 | Savage, Jr. | G08B 5/38 340/286.01 |
| 2007/0035255 | A1 | 2/2007 | Shuster et al. | 315/200 R |
| 2014/0333450 | A1 * | 11/2014 | Savage, Jr. | G08B 5/38 340/815.45 |

FOREIGN PATENT DOCUMENTS

| | | | |
|---|---|---|---|
| CN | 102246592 A | 11/2011 | H05B 33/08 |
| CN | 102282912 A | 12/2011 | H03M 3/02 |
| CN | 102484918 A | 5/2012 | H05B 33/08 |

(Continued)

OTHER PUBLICATIONS

European Extended Search Report, Application No. 16184803.1, 7 pages, dated Jan. 26, 2017.

*Primary Examiner* — Kerri McNally

(74) *Attorney, Agent, or Firm* — Slayden Grubert Beard PLLC

(57) ABSTRACT

A notification appliance in a fire fighting system may include at least one LED, a drive circuit, and a control circuit. The control circuit may be configured to output at least one flash control signal to the drive circuit in response to a candela setting, the flash control signal indicating a pulse waveform characteristic and a current amplitude of a drive current that is output by the drive circuit and can flow through the at least one LED. The candela setting may be selected from a plurality of optional candela settings, and the pulse waveform characteristic and the current amplitude indicated may be selected such that each light emission of the at least one LED can substantially minimize electric energy required for the candela setting.

12 Claims, 7 Drawing Sheets

(56) References Cited

FOREIGN PATENT DOCUMENTS

| | | | | |
|---|---|---|---|---|
| CN | 104470159 | A | 3/2015 | ..... H05B 37/02 |
| WO | 2006/107199 | A2 | 10/2006 | ..... H05B 33/08 |
| WO | 2013/188352 | A1 | 12/2013 | ..... G08B 5/38 |

* cited by examiner

NOTIFICATION APPLIANCE

CROSS-REFERENCE TO RELATED APPLICATIONS

This application claims priority to CN Application No. 201510528343.X filed Aug. 25, 2015, the contents of which are hereby incorporated by reference in their entirety.

TECHNICAL FIELD

The present invention generally relates to the field of fire alarms, in particular to a notification appliance capable of giving a visual alarm in a fire fighting system.

BACKGROUND

FIG. 1 shows a schematic diagram of a typical fire alarm system. As shown in FIG. 1, in a fire alarm system, a fire alarm control panel 160 is connected to a plurality of fire detectors 170, notification appliances 180, manual alarms 190, etc. distributed in buildings. The fire detectors 170, the notification appliances 180 and the manual alarms 190 are collectively referred to as peripheral devices. The peripheral device is connected to the fire alarm control panel 160 through a wired or wireless network. In the fire alarm system shown in FIG. 1, the notification appliance 180 may, for example, give an audio alarm (for example, by a buzzer or a loudspeaker), or give an observable visual alarm (for example, by using a strobe). For example, a flash visual alarm is particularly suitable for warning people who have hearing disorders, and is also particularly suitable for noisy environments, such as a shopping mall. For different application environments, preferably the light intensities of visual alarms differ accordingly. For example, for a baby's room, the candela setting of the visual alarm shall be relatively low, while a high candela setting is required in a noisy shopping mall. To this end, preferably the notification appliance shall provide, for example, at least four different candela settings of alarm light, for example, 15 candelas, 30 candelas, 75 candelas and 110 candelas, wherein candela is an international light intensity unit, denoted by cd.

In the prior art, typically, the notification appliance uses a xenon lamp as a flash element. A lamp tube filled with xenon is provided in such a typical notification appliance. When the lamp tube is supplied with a high voltage, the xenon inside the lamp tube is ionized and instantaneously conducted on, so as to generate flash with short duration and high intensity. The notification appliance with a xenon lamp is capable of releasing a sufficient intensity of light in a very short period of time. However, for the ionization of xenon inside the lamp tube, it is usually required to apply a voltage of several thousand volts as a trigger voltage to the lamp tube. Adjusting the trigger voltage applied to the xenon lamp tube can produce different levels of light intensity accordingly.

Another typical notification appliance is a notification appliance using a light emission diode (LED) as a flash element. The core of the LED is a semiconductor wafer, including a P-type semiconductor (mainly holes) and N-type semiconductor (mainly electrons), with a P-N junction being formed between the two semiconductors. When the driving current is flowing through the P-N junction on the wafer, the electrons will be pushed to a P zone where the electrons are combined with the holes and then generate energy in the form of photons. As compared with the xenon lamp, the LED lamp needs a lower drive voltage, has a higher luminous efficiency, and is energy-saving and environmentally friendly, but correspondingly has limited luminous intensity. Adjusting the intensity of the drive current flowing through the LED can achieve different levels of light intensity.

SUMMARY

One embodiment provides a notification appliance of a fire fighting system, the notification appliance comprising at least one LED; a drive circuit electrically coupled to the at least one LED to provide a drive current flowing through the at least one LED; and a control circuit electrically coupled to the drive circuit, wherein the control circuit is configured to output at least one flash control signal to the drive circuit in response to a candela setting, the flash control signal indicating a pulse waveform characteristic and a current amplitude of a drive current that can flow through the at least one LED; and wherein the candela setting is selected from a plurality of optional candela settings, and the pulse waveform characteristic and the current amplitude indicated are designed so that electric energy required by each light emission of the at least one LED is substantially minimal.

In one embodiment, the pulse waveform characteristic comprises a pulse width, which corresponds to the flash duration of the LED, and the at least one LED emits light within the flash duration.

In one embodiment, for any two of the candela settings, the pulse width of the pulse waveform and the current amplitude are both different.

In one embodiment, the pulse width in the pulse waveform and the current amplitude are determined according to a set of prestored data, and the prestored data is related to parameter characteristics of the at least one LED.

In one embodiment, the pulse width is less than 150 ms, preferably less than 50 ms, and more preferably less than 20 ms.

In one embodiment, pulse widths of pulse waveforms corresponding to different candela settings are different from each other, and a difference between different pulse widths is less than 50 ms, preferably less than 30 ms, and more preferably less than 10 ms.

In one embodiment, the pulse waveform characteristic and the current amplitude are designed so that each light emission of the at least one LED meets the determined candela setting and electric energy consumed is minimal.

In one embodiment, if a frequency of the pulse waveform is not changed, the pulse width and the current amplitude increase along with the increase in the determined candela setting.

In one embodiment, the notification appliance further comprises an energy storage element; a charging circuit, which charges the energy storage element; and a controlled switch element, which is connected between the charging circuit and the energy storage element, and is switched on in a non-strobe stage of the LED while switched off in a strobe stage of the LED.

BRIEF DESCRIPTION OF THE DRAWINGS

Example aspects and embodiment of the invention are described below with reference to the drawings, in which.

DETAILED DESCRIPTION

Figure 1:
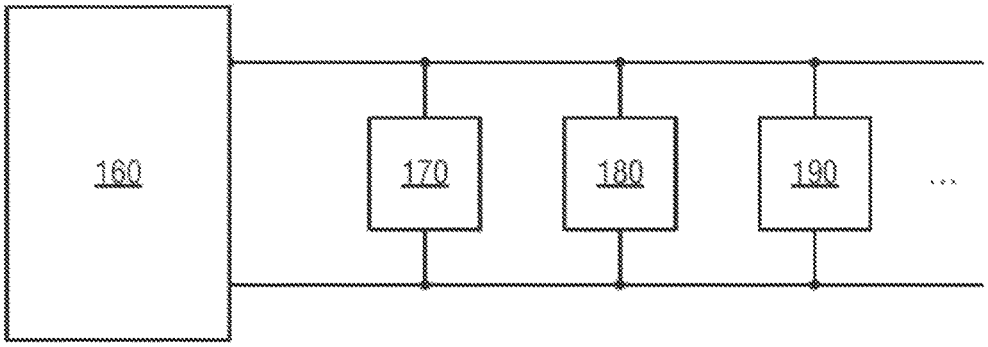
FIG. 1 shows a typical fire alarm system.

Embodiments of the present invention provide a notification appliance in a fire fighting system, the notification device comprising an LED and satisfying a plurality of different candela settings while having a low electric energy consumption. In some embodiments, the notification appliance in a fire fighting system, which is proposed in the present invention, comprises: at least one LED; a drive circuit electrically coupled to the energy storage element and the at least one LED to provide a drive current flowing through the at least one LED; and a control circuit electrically coupled to the drive circuit, wherein the control circuit is configured to output at least one flash control signal to the drive circuit in response to a candela setting, the flash control signal indicating a pulse waveform characteristic and current amplitude of the drive current that can flow through the at least one LED; and wherein the candela setting is selected from a plurality of optional candela settings, and the pulse waveform characteristic and the current amplitude indicated are designed so that electric energy required by each light emission of the at least one LED is substantially minimal. Preferably, the pulse waveform characteristic comprises a pulse width, which corresponds to a flash duration of the LED, and the at least one LED emits light within the flash duration. More preferably, the pulse waveform characteristic and the current amplitude are designed so that each light emission of the at least one LED meets the determined candela setting and electric energy consumed is minimal.

Using the notification appliance proposed by the present invention, since the flash duration (pulse width of drive current) of the LED is no longer a fixed value, the electric energy required by each light emission of the LED is reduced by reasonably setting the pulse width (flash duration) and the current amplitude of drive current. Moreover, the change in pulse width only needs to be controlled by the control circuit, without changing the hardware circuit. Thus, the notification appliance proposed by the present invention can achieve the purpose of optimizing the electric energy of the notification appliance by means of a simple structure.

In some embodiments, for any two candela settings, the pulse width of the pulse waveform and the current amplitude are both different. More preferably, the pulse width in the pulse waveform and the current amplitude are determined according to a set of prestored data, wherein the prestored data is related to parameter characteristics of the at least one LED.

In some embodiments, the pulse width is less than 150 ms, preferably less than 50 ms, and more preferably less than 20 ms. More preferably, pulse widths of the pulse waveform corresponding to different candela settings are different from each other, and a difference between different pulse widths is less than 50 ms, preferably less than 30 ms, and more preferably less than 10 ms. Preferably, if a frequency of the pulse waveform is not changed, the pulse width and the current amplitude also increase with the increase in the determined candela setting.

The use of the notification appliance proposed by the present invention can shorten the flash duration of the LED to be in line with the development direction of the industry of short-term high-power light output. Moreover, the shorter the flash duration of the LED is, the less obvious the difference between the LED flashes under different candela settings, which may not be sensed by human eyes.

In some embodiments, the notification appliance proposed by the present invention further comprises an energy storage element; a charging circuit, which can be powered from a power supply circuit connected to the notification appliance, so as to charge the energy storage element; and a controlled switch element, which is connected between the charging circuit and the energy storage element, and is switched on in a non-strobe stage of the LED while switched off in a strobe stage of the LED. Using this solution, drive current during the strobe of the LED will not be fed back to the power supply circuit, so as to avoid undesired current fluctuations on the power supply circuit, without the need of an additional filtering circuit to remove this interference.

For better understanding of the technical features, objects and effects of the present invention, the particular embodiments of the present invention will now be described herein with reference to the accompanying drawings, and the same numerals denote the components having the same or similar structure while having the same function throughout the drawings.

As used herein, the term "exemplary" means "serving as an example, instance, or description," and any "exemplary" illustration and embodiment herein should not be interpreted as a more preferred or a more advantageous technical solution.

For clarity of the drawings, only the relevant parts of the present invention are schematically shown throughout the drawings, and they do not represent the actual structure of a product. In addition, in order to make the drawing simple and easy to understand, only one of the components with the same structure or function in some of the drawings is schematically depicted, or only one of which is marked.

As used herein, "a/an" not only means "only one", but can also mean "more than one". In addition, as used herein, the terms "first" and "second" etc. are only used to distinguish one another, rather than conferring on them the degree of importance and order etc.

As described above, the existing notification appliance in a fire fighting system may need to provide, for example, at least four different candela settings of alarm light. For example, the candela settings may be 15 candelas, 30 candelas, 75 candelas and 110 candelas, respectively, the candela being an international light intensity unit. Generally, a notification appliance with light alarm will have a reference point specified by the manufacturer, and if the notification appliance is considered as a point light source, the reference point is the light source center of the point light source. The candela setting mentioned above refers to the light intensity which is obtained by means of a far-field measurement at a place which is at a predetermined distance (at least 3 m) away from the notification appliance and faces the reference point of the notification appliance. During installation, the candela setting that should be used by the current notification appliance can be pre-selected. For example, a notification appliance installed in a baby's room has a low requirement on light intensity, for example, set to be 15 candelas, while a notification appliance installed in a shopping mall has a high requirement on light intensity, for example, set to be 110 candelas. This selected candela setting can be prestored in the notification appliance, and may be delivered to the notification appliance through a communication bus, and may also be manually set on the notification appliance by a mechanical device.

The inventor of the present invention proposes that: for different candela settings, the light intensity of the LED can be changed not only by changing the intensity of current flowing through the LED, but also by changing the flash duration of LED. Further, considering the electric energy consumption problem of LED, the inventor of the present invention further proposes optimizing the current amplitude of the LED drive current and each flash duration of LED for different candela settings so as to reduce the electric energy consumption of strobe.

Figure 2:
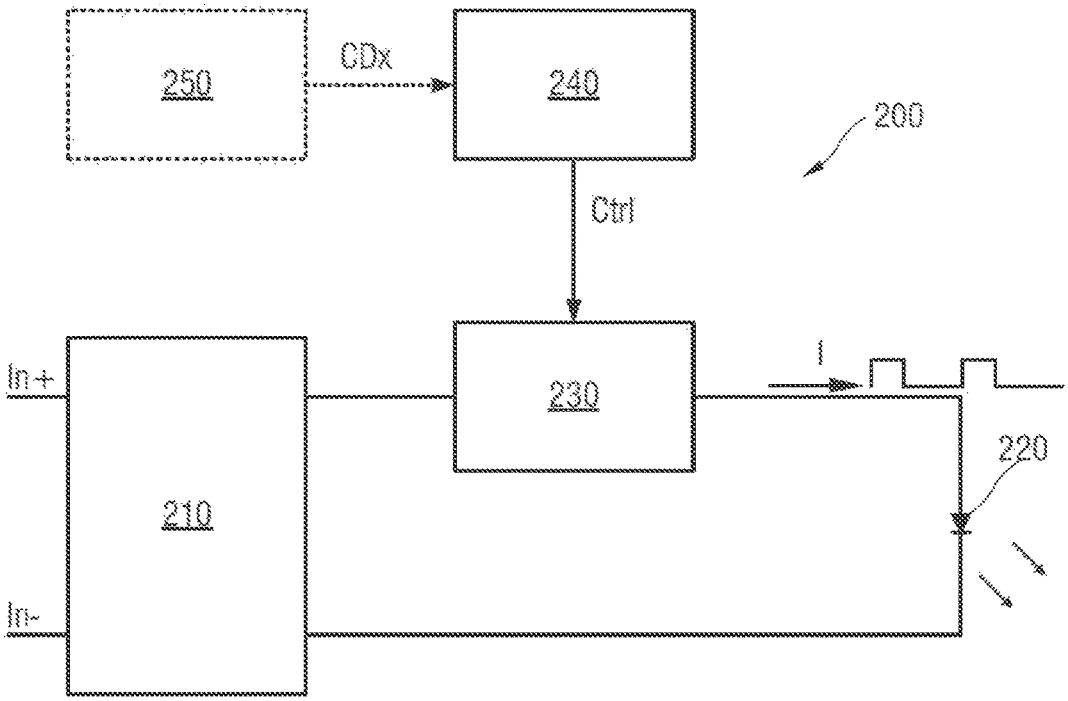
FIG. 2 shows a schematic circuit diagram of a notification appliance according to one embodiment of the present invention.

FIG. 2 exemplarily shows a notification appliance 200 in a fire fighting system according to one embodiment of the present invention. The notification appliance 200 may be specifically an independent light alarm, or may be a fire alarm device integrated/combined with fire detectors. The notification appliance 200 in FIG. 2 specifically comprises an energy storage element 210, an LED 220, a drive circuit 230 and a control circuit 240.

The energy storage element 210 is connected to two input ends In+ and In− of the notification appliance 200, and stores the energy from the input ends. The drive circuit 230 is connected in series with at least one LED 220, and is powered by the energy storage element 210. The energy storage element 210 is a high-capacity capacitor, for example. LED 220 may be a high-power LED particle, or may be a plurality of LED particles connected in series with each other, or even an LED integrated array comprising a plurality of LED particles arranged in a matrix.

The drive circuit 230 is electrically coupled to the energy storage element 210. The drive circuit 230, on the one hand, gets energy from the energy storage element 210 and, on the other hand, converts the obtained energy into a drive current I which enables the LED 220 to light up. Here, the drive current I has a pulse waveform. Under action of the drive current I, the LED 220 strobes periodically, for example, with a period of 1 s and a frequency of 1 Hz. The flash rate of the LED is consistent with the pulse frequency of the drive current I. The pulse width of the drive current I corresponds to the flash duration of the LED, and the LED emits light during the flash duration. The light output luminous flux of the LED is also in relation with the current amplitude of the drive current I. According to the LED performance parameters, the greater the drive current I, the greater the output luminous flux of the LED.

The control circuit 240 is electrically connected to the drive circuit 230. According to one (for example, preset/prestored) candela setting CDx (x is any of 1, 2, 3 and 4, representing one of the above four candela settings), the control circuit 240 can generate and send a flash control signal Ctrl to the drive circuit 230. The flash control signal Ctrl is used to indicate the pulse waveform characteristic and/or the current amplitude of the drive current I. The drive current I with the indicated pulse waveform characteristic and/or the current amplitude can enable the LED 220 to flash and emit light with the flash light intensity satisfying the requirement of the candela setting CDx.

As shown in FIG. 2, optionally the notification appliance 200 may further have a candela setting device 250 which can be connected to the control circuit 240 in a wired or wireless mode. The candela setting device may be a software/hardware setting tool installed on a remote fire alarm control panel 180. The candela setting device 250 may also be a selection switch installed on the notification appliance 200, for example, a one-out-of-four electronic or mechanical switch. The candela setting device 250 is used to determine a candela setting CDx (x=1, 2, 3, 4) and output the setting result to the control circuit 240, and the determined candela setting may be selected from a plurality of available candela settings (110, 75, 30, 15 candelas).

The basic principle for the control of LED light intensity will be described below, taking the circuit as shown in FIG. 2 as an example. As described above, the adjustable candela settings of the notification appliance generally include 110 cd, 75 cd, 30 cd and 15 cd, for example. Moreover, in a fire fighting system, the alarm light sent by the notification appliance 200 is in a pulsed mode, i.e., periodically strobes. To this end, the Blondel-Rey formula provides a method for measuring the effective pulse intensity:

$$Ie = d^2\left[\frac{\int_{t1}^{t2} I\,dt}{0.2 + (t2 - t1)}\right] \tag{1}$$

wherein Ie is an effective light intensity, in a unit of cd;

$t_2 - t_1$ is a flash duration of LED Ton;

d is a distance from the measurement point to the LED, generally being at least 3 m;

$\int_{t1}^{t2} I\,dt$ is an energy integral of the LED output luminous flux during the flash duration.

The relationship between the luminous flux and the flash duration can be further obtained on the basis of the above formula (1):

$$Ø \times T_{on} = (0.2 + T_{on})Ø_{eff} \tag{2}$$

wherein Ø is the LED output luminous flux, in a unit of lumen (lm), in relation to the LED drive current amplitude;

$T_{on}$ is the LED flash duration;

$Ø_{eff}$ the effective luminous flux contributing to the effective light intensity is in direct proportion to Ie, and $Ø_{eff}$ is in a unit of lm (lumen).

It is not difficult to find by the formula (2) that, assuming Ton to be a fixed value, Ø is in direct proportion to $Ø_{eff}$. Assuming the LED flash period to be 1 s, the Ton to be a fixed value of 100 ms, and the LED output luminous flux Ø to be 1000 lm, the corresponding central light intensity is just 110 cd. As such, Ø and $Ø_{eff}$ corresponding to the other three levels of candela settings can be calculated in sequence based on formula (2). Ø and $Ø_{eff}$ calculated, when the Ton is a fixed value of 100 ms, under four candela settings, 110 cd, 75 cd, 30 cd and 15 cd are listed in Table 1. Furthermore, each LED leaving the factory will have a product manual, and the LED performance parameters given by the product manual can be used to calculate and obtain a comparison table between the drive current and the output luminous flux. After determining Ø according to the formula (2), the corresponding parameters, such as the drive current I, tube voltage drop V, etc., can be obtained by looking up the LED parameter comparison table. A comparison table for the drive current I, output luminous flux Ø, tube voltage drop V, and energy E, taking performance parameters of a market-available LED as an example, is listed in Table 2. Based on the parameters in Table 2, the drive current I and tube voltage drop V required by and the electric energy E consumed by each LED flash under different candela settings can be further obtained, see Table 1.

TABLE 1

The LED output, when the Ton is a fixed value of 100 ms, under the candela settings of 110 cd, 75 cd, 30 cd and 15 cd.

| | Candela settings | | | |
|---|---|---|---|---|
| | 110 cd | 75 cd | 30 cd | 15 cd |
| Ton (ms) | 100 | 100 | 100 | 100 |
| Ø (lm) | 1000 | 681 | 279 | 145 |
| $Ø_{eff}$ (lm) | 333 | 227 | 90 | 45 |
| V (V) | 3.35 | 3.17 | 2.87 | 2.78 |
| I (mA) | 3000 | 1700 | 600 | 300 |
| E (J) | 1 | 0.54 | 0.1723 | 0.0835 |

TABLE 2

The comparison table for the current I, output luminous flux Ø, tube voltage drop V and energy E obtained on the basis of the LED performance parameters.

| I (A) | Ø (lm) | V (V) | E (J) |
|---|---|---|---|
| 0.15 | 74 | 2.73 | 0.4095 |
| 0.2 | 98.3 | 2.75 | 0.55 |
| 0.25 | 122.2 | 2.77 | 0.6925 |
| 0.3 | 145.7 | 2.78 | 0.834 |
| 0.35 | 168.8 | 2.8 | 0.98 |
| 0.4 | 191.6 | 2.81 | 1.124 |
| 0.45 | 214 | 2.83 | 1.2735 |
| 0.5 | 236.1 | 2.84 | 1.42 |
| 0.55 | 257.7 | 2.86 | 1.573 |
| 0.6 | 279.1 | 2.87 | 1.722 |
| 0.65 | 300.2 | 2.88 | 1.872 |
| 0.7 | 320.8 | 2.9 | 2.03 |
| 0.75 | 341.2 | 2.91 | 2.1825 |
| 0.8 | 361.2 | 2.92 | 2.336 |
| 0.85 | 381 | 2.94 | 2.499 |
| 0.9 | 400.4 | 2.95 | 2.655 |
| 0.95 | 419.5 | 2.96 | 2.812 |
| 1 | 438.3 | 2.97 | 2.97 |
| 1.1 | 475.1 | 3 | 3.3 |
| 1.2 | 510.7 | 3.02 | 3.624 |
| 1.3 | 545.3 | 3.04 | 3.952 |
| 1.4 | 578.7 | 3.06 | 4.284 |
| 1.5 | 611.2 | 3.08 | 4.62 |
| 1.6 | 642.7 | 3.1 | 4.96 |
| 1.7 | 673.4 | 3.12 | 5.304 |
| 1.8 | 703.2 | 3.14 | 5.652 |
| 1.9 | 732.2 | 3.16 | 6.004 |
| 2 | 760.4 | 3.17 | 6.34 |
| 2.1 | 787.8 | 3.19 | 6.699 |
| 2.2 | 814.6 | 3.21 | 7.062 |
| 2.3 | 840.7 | 3.23 | 7.429 |
| 2.4 | 866.2 | 3.24 | 7.776 |
| 2.5 | 891.2 | 3.26 | 8.15 |
| 2.6 | 915.5 | 3.28 | 8.528 |
| 2.7 | 939.5 | 3.29 | 8.883 |
| 2.8 | 963.1 | 3.31 | 9.268 |
| 2.9 | 986.1 | 3.33 | 9.657 |
| 3 | 1008.8 | 3.35 | 10.05 |

It can be seen from Table 1 that, under different candela settings, the electric energy required by each LED flash does not change linearly.

Figure 3:
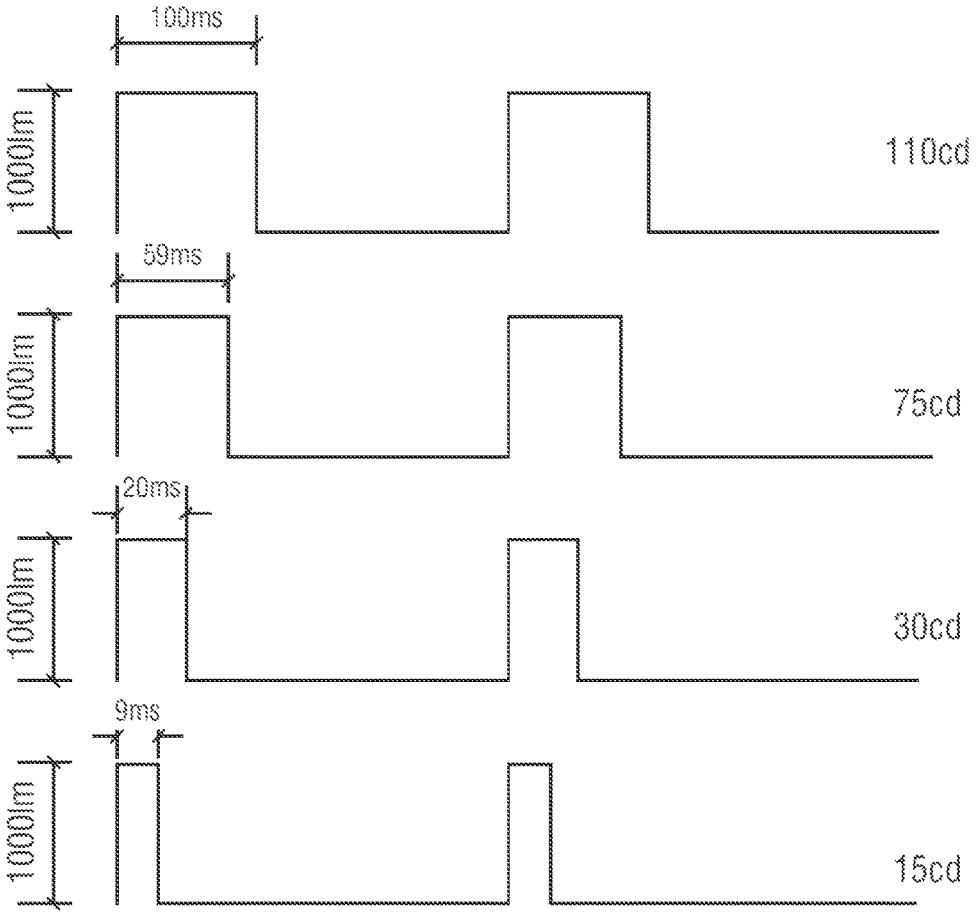
FIG. 3 shows the pulse waveform of the LED output light in a notification appliance according to one embodiment of the present invention.

The inventor of the present invention proposes that variable flash durations may also be used to satisfy different candela settings. Still taking the circuit in FIG. 2 as an example, the difference is that the flash control signal Ctrl indicates a fixed current amplitude and a variable pulse width (i.e., the flash duration), rather than only indicating the current amplitude. It is still assumed that, when the Ton is 100 ms, the LED output luminous flux Ø is 1000 lm and the corresponding central light intensity is just 110 cd. As such, the LED drive current when Ø is 1000 lm can be used as a constant drive current, for example. Based on $Ø_{eff}$ obtained from Table 1 and the formula (2), Ø corresponding to the other three levels of candela settings can be calculated in sequence. Further, the Ton time and the electric energy E required under different candela settings can be obtained by looking up Table 2. The Ton time calculated as such is listed in Table 3, and FIG. 3 shows pulse waveform patterns of the LED output light under drive of the drive current I in Table 3. It can be seen from FIG. 3 that, in the case that the drive current is constant, the peak value of the luminous flux of the LED output light is the same as that of the light output under 1000 lm, but the flash duration is reduced with the down setting of candela settings so as to satisfy the corresponding requirements of light intensity.

TABLE 3

The LED output, when the drive current is a fixed value of 3A, under the candela settings of 110 cd, 75 cd, 30 cd and 15 cd.

| | Candela settings | | | |
|---|---|---|---|---|
| | 110 cd | 75 cd | 30 cd | 15 cd |
| Ton (ms) | 100 | 58.7 | 20 | 9 |
| Ø (lm) | 1000 | 681 | 279 | 145 |
| $Ø_{eff}$ (lm) | 333 | 227 | 90 | 45 |
| V (V) | 3.35 | 3.35 | 3.35 | 3.35 |
| I (mA) | 3000 | 3000 | 3000 | 3000 |
| E (J) | 1 | 0.587 | 0.2 | 0.09 |

It can be seen from Table 3 that, in the case of the fixed drive current I, under different candela settings, the electric energy required by each LED flash also does not change linearly.

Given the electric energy change regularity found in Table 1 and Table 3, the inventor of the present invention further proposes that the LED electric energy consumption can be reduced by simultaneously optimizing the Ton and drive current amplitude.

Figure 4:
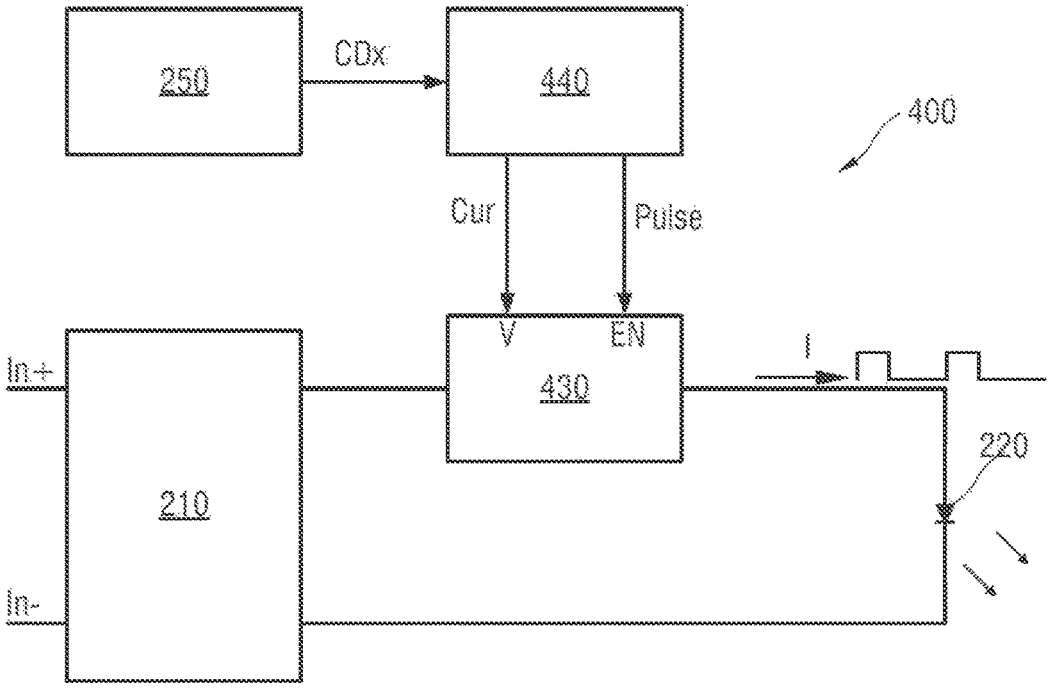
FIG. 4 shows a schematic circuit diagram of a notification appliance according to a further embodiment of the present invention.

FIG. 4 exemplarily shows a notification appliance 400 in a fire fighting system according to a further embodiment of the present invention. The same components of the notification appliance 400 as those in FIG. 2 are marked with the same reference numerals, and have the same functions, which is not described herein again. It differs from FIG. 2 in that the flash control signal Ctrl in FIG. 4 is replaced by two separate control signals Cur and Pulse. The control signal Cur output from a control circuit 440 is used to adjust the current amplitude of the LED drive current I, and is connected to a current setting end V of a drive circuit 430. The control signal Pulse output from the control circuit 440 is used to adjust the pulse waveform of the drive current I, i.e., to adjust the pulse width. The Pulse is connected to an enable end EN of the drive circuit 430. Optionally, Cur and Pulse can also be presented by a control signal (for example, a pulse signal), i.e., the pulse signal amplitude indicates the current amplitude, and the pulse signal pulse width indicates the flash duration.

In FIG. 4, the electric energy consumed by the LED can be optimized by simultaneously adjusting the current amplitude and the pulse width (flash duration) of the drive current. It is still assumed that, when the Ton is 100 ms, the LED output luminous flux Ø is 1000 lm and the corresponding central light intensity is just 110 cd. Likewise, based on the above formula (2), different combinations of Ton and current amplitude satisfying the corresponding candela settings (110 cd, 75 cd, 30 cd, 15 cd) can be calculated, and then the consumed electric energy E can be obtained by looking up Table 2.

Figure 5:
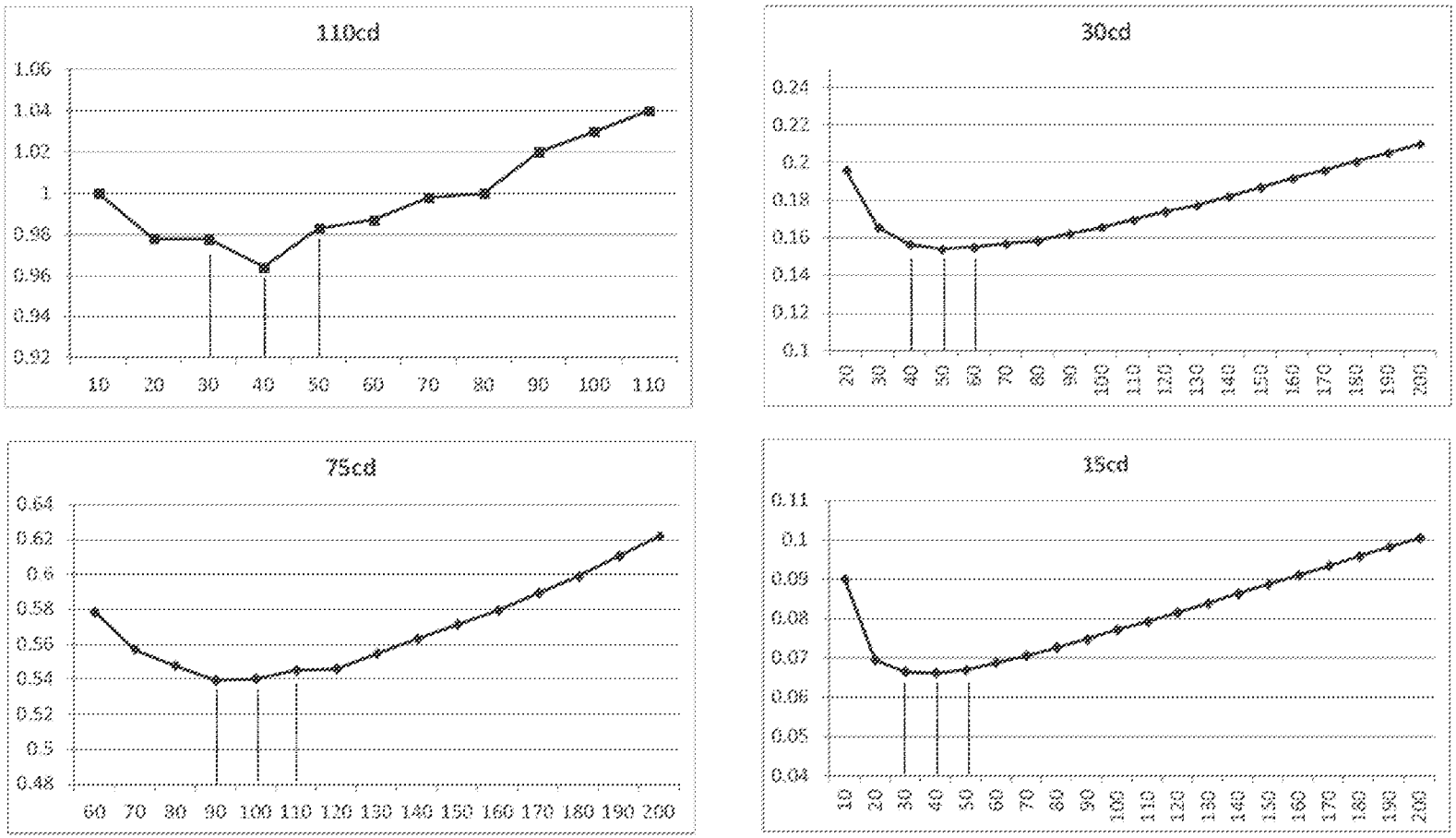
FIG. 5 shows a change curve of electric energy required by each light emission of an LED under different candela settings over time in the flash duration.
Figure 6:
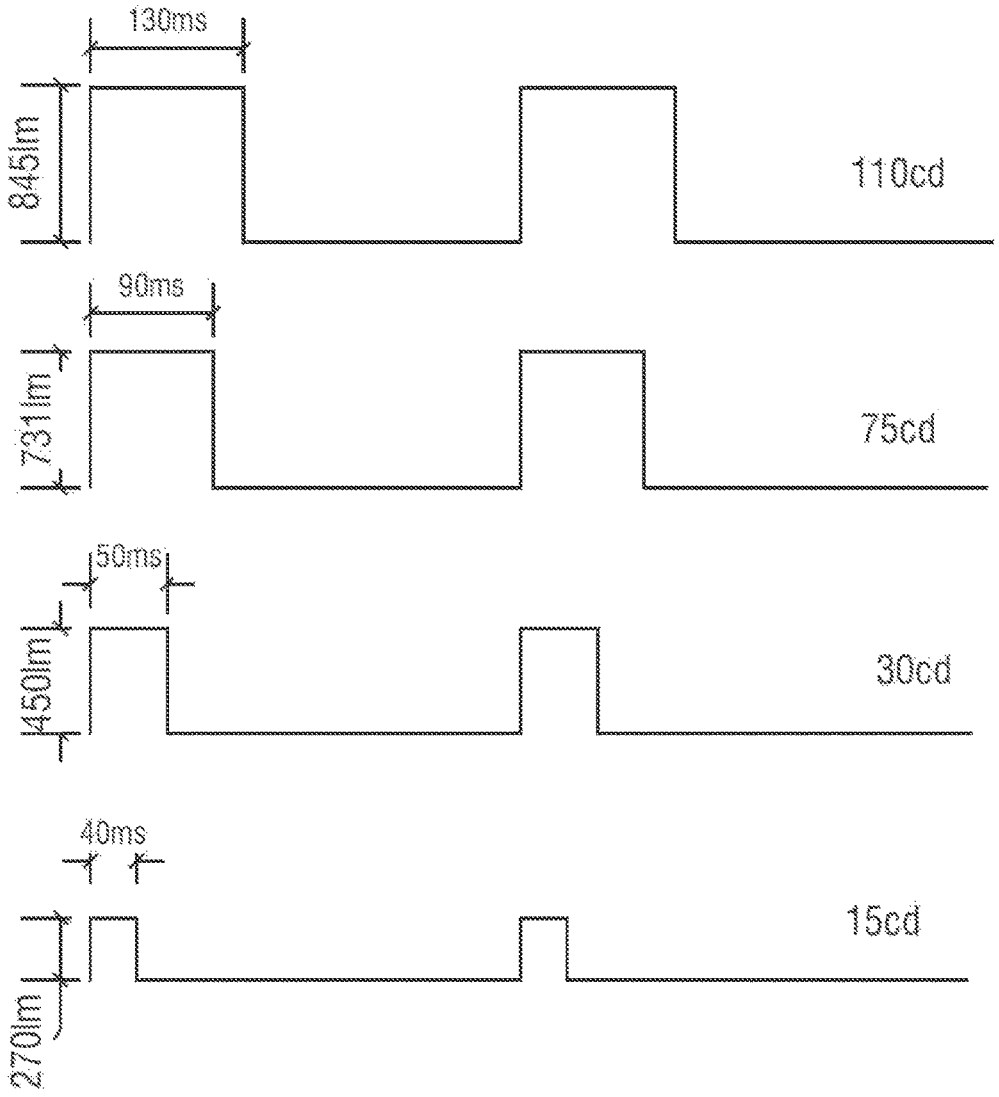
FIG. 6 shows the pulse waveform of the LED output light in a notification appliance according to a further embodiment of the present invention.

FIG. 5 shows the electric energy E consumed by each LED flash, when satisfying four different candela settings, changing with the Ton. As shown in FIG. 5, for each candela setting, a preferred operating point consuming low electric energy can be always found, and at this preferred operating point, the combination of the Ton and the drive current I can reduce the LED electric energy consumption. Specifically, in FIG. 5, under each candela setting, at least three preferred operating points can be found, for example. As compared with the other operating points, the electric energy consumption at the three operating points are lower. An operating point with the minimal electric energy consumption can be further found from the three preferred operating points, and this point is the optimal operating point. The optimal operating points calculated according to the LED performance parameters listed in Table 2 are listed in Table 4. FIG. 6 shows the LED light output waveforms at the optimal operating points, optimized as such, under different candela settings. As shown in FIG. 6, the LED flash frequency is constant (1 Hz), but the LED flash duration and output luminous flux amplitude (corresponding to the drive current amplitude) under any two different candela settings are different from each other. Moreover, with the increase in the candela setting, the flash duration and the drive current amplitude both increase.

TABLE 4

The combination of Ton and I for the minimal electric energy consumption for each flash under the candela settings of 110 cd, 75 cd, 30 cd and 15 cd.

| | Candela settings | | | |
|---|---|---|---|---|
| | 110 cd | 75 cd | 30 cd | 15 cd |
| Ton (ms) | 130 | 90 | 50 | 40 |
| Ø (lm) | 845 | 731 | 450 | 270 |
| $Ø_{eff}$ (lm) | 333 | 227 | 146 | 45 |
| V (V) | 3.23 | 3.16 | 2.98 | 2.75 |
| I (mA) | 2300 | 1900 | 1030 | 600 |
| E (J) | 0.946 | 0.53 | 0.154 | 0.066 |

It can be further seen from FIG. 5 that, with the increase of Ton, the electric energy consumption of each LED flash also gradually increases. Preferably, the shorter the Ton time is, the better. As shown in FIG. 5, Ton is preferably less than 150 ms, more preferably less than 50 ms, most preferably less than 20 ms. Moreover, the shorter the upper limit of Ton, the less the difference in Ton under different candela settings. Certainly, with the reduction of Ton, in order to achieve the same output light intensity, it is required to increase the amplitude of the drive current I accordingly. Considering the synchronization of the notification appliance under different candela settings, preferably the difference in Ton under different candela settings is less than or equal to 30 ms, preferably less than 30 ms, more preferably less than 10 ms. To reduce the difference in Ton under the optimization condition, it is required to increase the amplitude of the drive current accordingly. This can be determined according to the LED characteristic parameters.

Preferably, the notification appliance may also prestore an LED characteristic parameter table (for example, a comparison table between the drive current I and the output luminous flux). Obviously, this characteristic parameter table can include a reference value, i.e., the LED output luminous flux corresponding to one of the candela settings. For example, as described above, the control circuit 240 in the notification appliance can prestore the LED output luminous flux corresponding to 110 cd and the drive current I corresponding to same. Then, when the control circuit 240 receives the determined candela setting, based on the above formula 2 and the LED characteristic parameter table, the Ton and current amplitude of the current need can be calculated. Optionally, the control circuit 240 can be prestored with a comparison table of candela settings and drive current settings, as shown in Table 4, for example. When the control circuit 240 receives the determined candela setting, the corresponding pulse width and current amplitude can be determined by looking up Table 4.

Figure 7:
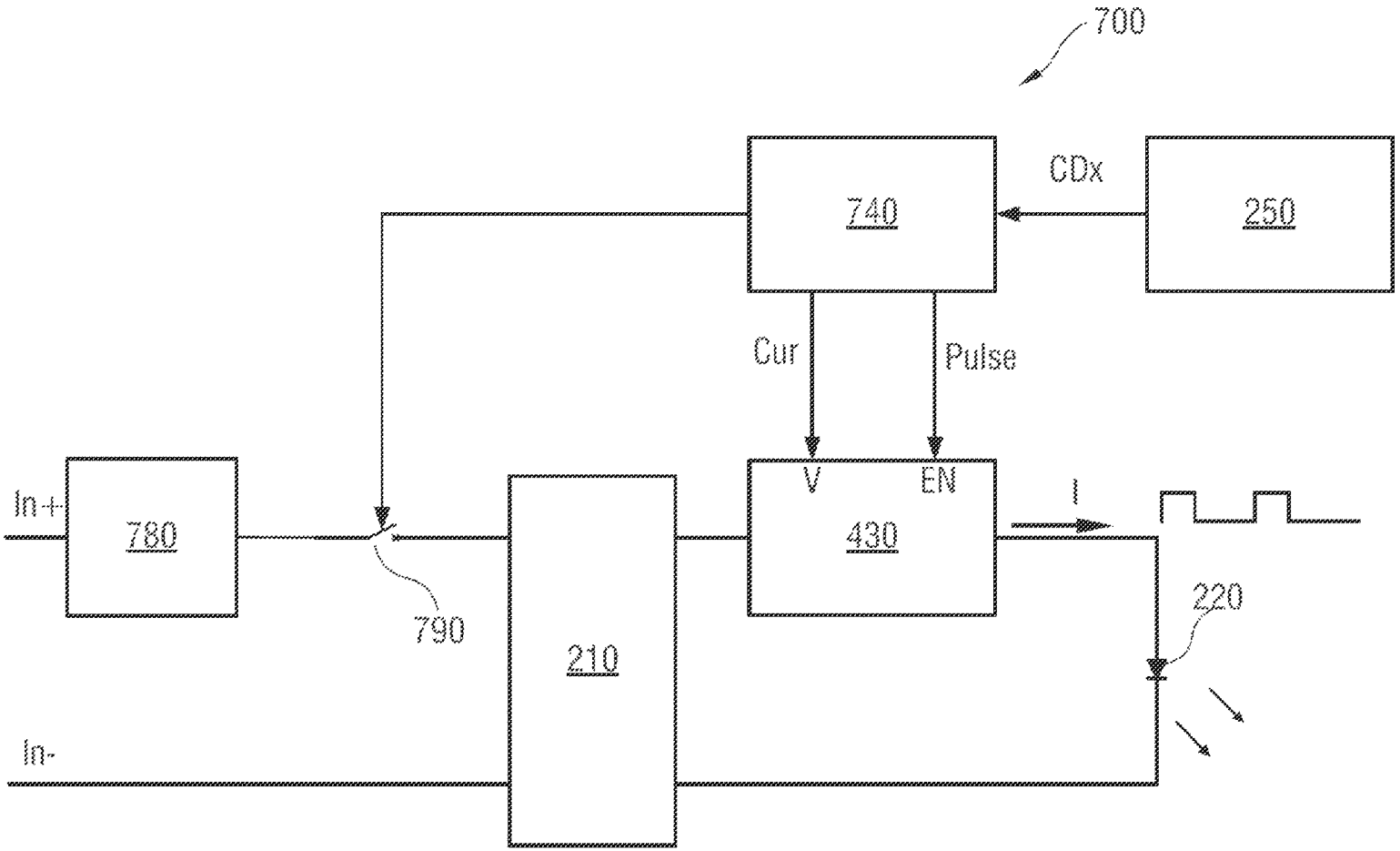
FIG. 7 shows a schematic circuit diagram of a notification appliance according to another embodiment of the present invention.

FIG. 7 shows a schematic diagram of a notification appliance 700 according to one embodiment of the present invention. FIG. 7 differs from FIG. 4 as follows: preferably the notification appliance 700 further comprises a charging circuit 780 connected to the input end and a controlled switch element 790 connected between the charging circuit 780 and the energy storage element 210. Here, input ends In+ and In− of a plurality of different notification appliances are generally connected in parallel to a power supply circuit powered by a fire alarm control panel 180. When the plurality of notification appliances are strobing at the same time, the notification appliances all draw current from the power supply circuit. Thus, the current on the LED may influence the current intensity on the power supply circuit. To this end, in the example as shown in FIG. 7, a switch element 790 is specifically provided and controlled by a control circuit 740. When the LED is strobing, the control circuit 740 causes the switch element 790 to switch off, so that the current change in the loop where the LED is located will not cause any influence on the input end. In the non-strobe stage of LED, the control circuit 740 causes the switch element 790 to switch on, so that the charging circuit 780 charges the energy storage element 210. Due to the switch element 790, the drive current during the strobe of LED will not be fed back to the power supply circuit, so as to avoid undesired current fluctuations on the power supply circuit.

It should be understood that, although the description is given according to each of the embodiments, each embodiment does not only comprise an independent technical solution, as this narrative manner of the description is only for clarity, and for a person skilled in the art, the description shall be regarded as a whole, and the technical solution in each of the embodiments can also be properly combined to form other implementations that can be understood by a person skilled in the art.

The series of detailed descriptions set forth above is merely directed to specific descriptions of feasible embodiments of the present invention, they are not intended to limit the scope of protection of the present invention, and any equivalent embodiment or alteration of the present invention, such as a combination of features, a segmentation or duplication, made without departing from the technical spirit of the present invention, shall be included within the scope of protection of the present invention.

What is claimed is:

1. A notification appliance of a fire fighting system, the notification appliance comprising:

at least one LED;

a drive circuit electrically coupled to the at least one LED and configured to provide a drive current flowing through the at least one LED; and a control circuit electrically coupled to the drive circuit, wherein the control circuit is configured to generate and send at least one flash control signal to the drive circuit in response to a candela setting, the flash control signal indicating a pulse waveform characteristic including a pulse width and an amplitude of a drive current for the at least one LED;

an energy storage element;

a charging circuit that charges the energy storage element; and a controlled switch element connected between the charging circuit and the energy storage element, wherein the controlled switch element is switched on in a non-strobe stage of the LED and switched off in a strobe stage of the LED;

wherein the candela setting is selected from a plurality of optional candela settings, and the pulse width and the current amplitude indicated by the flash control signal are selected to provide a substantially minimal electric energy requirement for each light emission of the at least one LED.

2. The notification appliance of claim 1, wherein, for any two of the candela settings, both the respective pulse widths of the respective pulse waveform and the respective current amplitudes are different.

3. The notification appliance of claim 1, wherein the pulse width in the pulse waveform and the current amplitude are determined according to a set of prestored data, and the prestored data is related to parameter characteristics of the at least one LED.

4. The notification appliance of claim 1, wherein the pulse width is less than 150 ms.

5. The notification appliance of claim 1, wherein pulse widths of pulse waveforms corresponding to different candela settings are different from each other, and a difference between different pulse widths is less than 50 ms.

6. The notification appliance of claim 1, wherein the pulse waveform characteristic and the current amplitude are selected such that each light emission of the at least one LED meets the determined candela setting and electric energy consumed is minimal.

7. The notification appliance of claim 1, wherein, if a frequency of the pulse waveform is not changed, the pulse width and the current amplitude increase along with an increase in the determined candela setting.

8. The notification appliance of claim 1, wherein the pulse width is less than 50 ms.

9. The notification appliance of claim 1, wherein the pulse width is less than 20 ms.

10. The notification appliance of claim 1, wherein pulse widths of pulse waveforms corresponding to different candela settings are different from each other, and a difference between different pulse widths is less than 30 ms.

11. The notification appliance of claim 1, wherein pulse widths of pulse waveforms corresponding to different candela settings are different from each other, and a difference between different pulse widths is less than 10 ms.

12. A method for controlling a fire fighting system notification appliance including at least one LED, a drive circuit electrically coupled to the at least one LED, and a control circuit electrically coupled to the drive circuit, the method comprising:

generating, by the control circuit, at least one flash control signal in response to a candela setting, the flash control signal indicating a pulse waveform characteristic including a pulse width and an amplitude of a drive current for the at least one LED;

wherein generating the at least one flash control signal comprises:

selecting the candela setting from a plurality of optional candela settings, and selecting the pulse width and the amplitude are selected to provide a substantially minimal electric energy requirement for each light emission of the at least one LED;

sending, by the control circuit, the at least one flash control signal to the drive circuit; and providing, by the drive circuit, a drive current to the at least one LED based on the received at least one flash control signal;

wherein the drive current comes from an energy storage element charged by a charging circuit and a controlled switch element connected between the charging circuit and the energy storage element, wherein the controlled switch element is switched on in a non-strobe stage of the LED and switched off in a strobe stage of the LED.

* * * * *